US009861849B2

(12) United States Patent
Grund et al.

(10) Patent No.: US 9,861,849 B2
(45) Date of Patent: Jan. 9, 2018

(54) FASTENING SYSTEM FOR A SPORTS AND RECREATIONAL FACILITY

(71) Applicant: Bergsee Sport UG, Rostock (DE)

(72) Inventors: Michael Grund, Rostock (DE); Stephan Chudowski, Rostock (DE)

(73) Assignee: Bergsee Sport UG, Rostock (DE)

( * ) Notice: Subject to any disclaimer, the term of this patent is extended or adjusted under 35 U.S.C. 154(b) by 0 days.

(21) Appl. No.: 15/147,632

(22) Filed: May 5, 2016

(65) Prior Publication Data

US 2016/0325130 A1 Nov. 10, 2016

(30) Foreign Application Priority Data

May 6, 2015 (DE) ..... 10 2015 107 075

(51) Int. Cl.
*A63B 4/00* (2006.01)
*A63B 7/08* (2006.01)

(52) U.S. Cl.
CPC ..... *A63B 7/085* (2013.01); *A63B 2209/00* (2013.01)

(58) Field of Classification Search
CPC ..... A63B 7/085; A63B 2209/00; A63B 1/00; A63B 7/00; A63B 7/04; A63B 7/045; A63B 7/08; A63B 26/00; H02H 1/02; H02H 1/04; H02H 3/22; H02H 7/00
USPC ..... 254/134.3 FT, 134.3 CL, 134.3 R; 294/74
See application file for complete search history.

(56) References Cited

U.S. PATENT DOCUMENTS 4,125,257 A * 11/1978 Lew ..... A63B 7/00 24/129 B
5,538,223 A * 7/1996 Scace ..... B63H 9/10 254/391
8,986,178 B2 * 3/2015 Klopman ..... A63B 7/085 482/142
9,115,783 B2 * 8/2015 Riedrich ..... F16G 3/16

FOREIGN PATENT DOCUMENTS

EP 2065077 6/2009

* cited by examiner

*Primary Examiner* — Loan H Thanh
*Assistant Examiner* — Megan Anderson
(74) *Attorney, Agent, or Firm* — Muncy, Geissler, Olds & Lowe, P.C.

(57) ABSTRACT

The invention relates to a fastening system for a sports and recreation device. The fastening system comprises a slackline, two band clamps, and a block and tackle, and two round slings. The fastening system is characterized in that the band clamps and the block and tackle comprise round-sling bolts and slackline bolts, wherein the round-sling bolts and the slackline bolts can be guided in elongated holes and functional holes vertically with respect to their axes and can be displaced, in the direction of their axes, through cut-outs in the functional holes. The bolts, at each of their two ends, comprise bolt heads having a diameter that is smaller than the cut-outs but larger than the elongated holes.

6 Claims, 9 Drawing Sheets

FASTENING SYSTEM FOR A SPORTS AND RECREATIONAL FACILITY

BACKGROUND OF THE INVENTION

The invention relates to a fastening system for a sports and recreation device, specifically a fastening system for so-called slacklines.

Slacklines have developed into a trend in recent years. In this sport, which is also performed as a recreational activity, a person balances on a tubular band or belt webbing in a manner similar to tightrope walking. This band is tensioned between two fastening points so as to be more or less taut. This trend sport has also become popular because the athlete is greatly challenged by the interplay of balance, coordination, and concentration. For this reason, it is particularly popular among athletes who need to have a good sense of equilibrium for their particular sport. These include sports such as climbing, horseback riding and vaulting, skiing, and snowboarding, as well as martial arts.

The slackline can be set up virtually anywhere, although the rope, is usually stretched between trees or poles. Particularly popular locations are a person's own yard or any park. After the slackline has been used, it can be quickly taken down and packed up. Trees prevent the fastening elements from supping, even if the rope has been only slightly tensioned, since there is sufficient friction between the fastening material and the bark of the tree. Specifically, a first round sling is placed around a first tree and is then connected to the slackline by means of a shackle or a similar object. A device for shortening the slackline to a sufficient extent is typically provided between the slackline and a second round sling on a second tree for the purpose of tensioning the slackline to a certain pretension, which is specified by the user. This device is often a block and tackle, which includes a first rope, which is fastened to the slackline by means of a shackle, and includes another rope, which is connected to the second round sling, likewise by means of a shackle, or is the second round sling itself. With shackles in particular, a difficulty arises in that the bolt or socket pin used to close the shackle often drops out of the shackle when the slackline is set up or taken down and, therefore, must be replaced relatively often. If parts are missing and have not been replaced, however, the slackline cannot always be set up at the desired time.

As a remedy for this deficiency in the prior art, a set for the installation of a slackline is known from the disclosure EP 2 065 077 B1, according to which a slackline is formed from two round slings and one rope. The slackline also comprises a tensioning element. An eye is provided at least at one end of the rope. This eye is engaged in a first round sling, which has a functional element, by means of which the round sling can be shortened to a required size, and which has a hook, which is intended to be engaged in the eye. A second functional element is connected to the slackline and is connected to the aforementioned round sling by means of a tensioning belt. The second functional element replaces a block and tackle. The round sling is shortened to the required dimensions by means of the functional element in order to optimally adjust the round song at the fixing points. Even if shackles are ultimately dispensed with in this manner, one must consider the disadvantage that the guidance of the rope in the functional elements is extremely complicated, which makes it very difficult to adjust the round slings at the fixing points and to replace a functional element. Users who do not have great dexterity could be overwhelmed by the attachment process. In addition, if a first round sling is engaged incorrectly or if a functional element is not optimally engaged in the first eye, rather than the slackline being hung with the desired orientation, it may be slightly twisted. This interferes with the functionality of the slackline and with the user's enjoyment.

Another disadvantage of known fastening systems for slacklines, in addition to the large number of individual parts that can get lost, is that the use of shackles always results in a very great overall weight for the fastening system. For many users, the great weight is the reason why they tend to use the device in one place. This goes against the fundamental concept.

SUMMARY OF THE INVENTION

Therefore, the object of the invention is to provide a fastening system for a sports and recreation device, which comprises a limited number of parts without detachable elements, in order to avoid loss, and which makes it possible to attach the slackline securely and without twisting.

The object is achieved by a system comprising a first round sling, a first band clamp, a slackline, a second band clamp, a block and tackle, and a second round sling. The first band clamp is designed in such a way that the band clamp comprises round-sling bolts for accommodating the first round sling and a slackline bolt for accommodating the slackline, wherein the axes through the round-sling bolts are disposed at a substantially right angle to the axis through the slackline bolt. For assembly, the first round sling is placed around a first fixing point and is fastened to the first band clamp by means of the round-sling bolts. The slackline is fastened on the slackline bolt and is routed around a deflecting roller in the interior of the band clamp and in the direction of a second fixing point. The second end of the slackline is also placed around a deflecting roller in the interior of the second band clamp and is then fastened to a slackline bolt. The second band clamp, at the end thereof facing away from the slackline, is accommodated in the block and tackle.

The block and tackle comprises a first and a second block and tackle element. A block and tackle rope, which has been tied in a knot at one block and tackle element, is tensioned between these block and tackle elements, back and forth over rollers, and therefore the effect of the block and tackle can be deployed by pulling on the loose end. A brake disposed at one of the block and tackle elements prevents the block and tackle from inadvertently coming loose, which would result in the loosening of the slackline and, in the worst case during use, in the athlete falling. Since the brake is disposed at one of the block and tackle elements, the brake, which, according to the prior art, was always additionally incorporated into the fastening system, is fixedly connected to the corresponding block and tackle element, and therefore a further assembly can be dispensed with. The design is therefore simplified. In addition, a round-sling bolt is provided at the first block and tackle element, with the aid of which a second round sling, which has been placed around the second fixing point, can be fastened to the block and tackle. The block and tackle is used to tension the slackline to the extent desired by the athlete.

All the bolts have two bolt heads. Moreover, the band clamps and the block and tackle each comprise at least two planar elements, which are fixedly connected to one another. One of the outer planar elements comprises elongated holes, wherein the bolt heads are designed so as to be incapable of falling through the elongated holes. Functional holes are located at corresponding points of the opposing, outer planar element. The functional holes are designed in such a way that they have a cut-out through which a bolt head fits and, adjoining the cut-out, a recess through which the bolt heads do not fit. These recesses and the elongated holes in the corresponding planar elements have the same orientation. The functional holes are designed in such a way that the bolts move into the adjoining recess when a tensile load is applied to the band clamps or the block and tackle. As soon as tension is released from the particular object, the bolts can be moved into the region of the cut-out. Since the bolt heads can be pushed through the cut-out, the device components secured by the bolt can be removed.

In addition, a multiplier can be provided, which is engaged on the block and tackle rope. This allows the tensile force applied to the block and tackle rope by the user to be further increased.

The technique for attaching the round slings is changed in order to dispense with the shackle, by means of which the block and tackle is connected to the round slings according to the prior art. For the purpose of attachment, the ends of the round slings are crossed one over the other and are then fastened to the first block and tackle element by means of the round-sling bolt. In a design of the first block and tackle element having three planar elements disposed in parallel, the round-sling end on the right on the slackline axis is engaged on the left in the first block and tackle element, and the round-sling end on the left on the slackline axis is engaged on the right. Lateral forces from the round sling that act on the first block and tackle element now act against one another on the middle planar element of the first block and tackle element, and therefore the attachment meets the highest safety requirements.

BRIEF DESCRIPTION OF THE DRAWINGS

The invention is described in greater detail with reference to drawings. In the drawings.

DETAILED DESCRIPTION OF THE INVENTION

Figure 1:
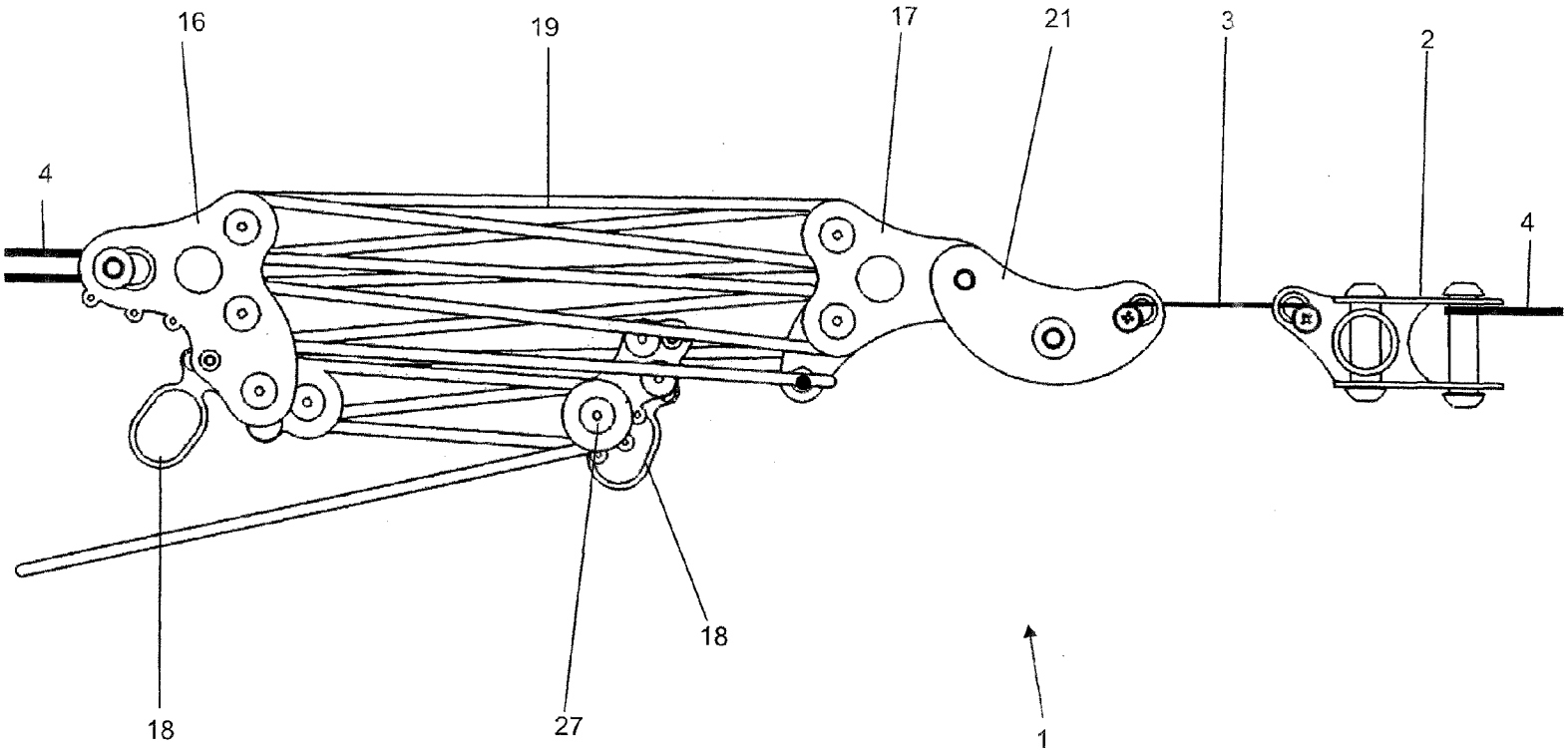
FIG. 1: shows a side view of the fastening system according to the invention.

FIG. 1 shows a side view of the fastening system 1 according to the invention. A first band clamp 2 is fastened to a non-illustrated fixing point with the aid of a round sling 4. A slackline 3 is inserted into the first band clamp 2 and is also connected to a second band clamp 21. The drawings are not to scale, such that the slackline 3 as shown is shorter than it would be in use. The second band clamp 21 and a second block and tackle element 17 are also connected to one another. For the purpose of tightening the slackline 3, the second block and tackle element 17 is connected, by means of a rope, to a first block and tackle element 16, which in turn is fastened to a second fixing point by means of a round sling 4. The rope is pulled in order to tension the slackline to the extent desired by the user. This is simplified by also engaging a multiplier 27 having a further brake 18 on the block and tackle rope 19, the multiplier minimizing the tensile force that the user must apply.

Figure 2:
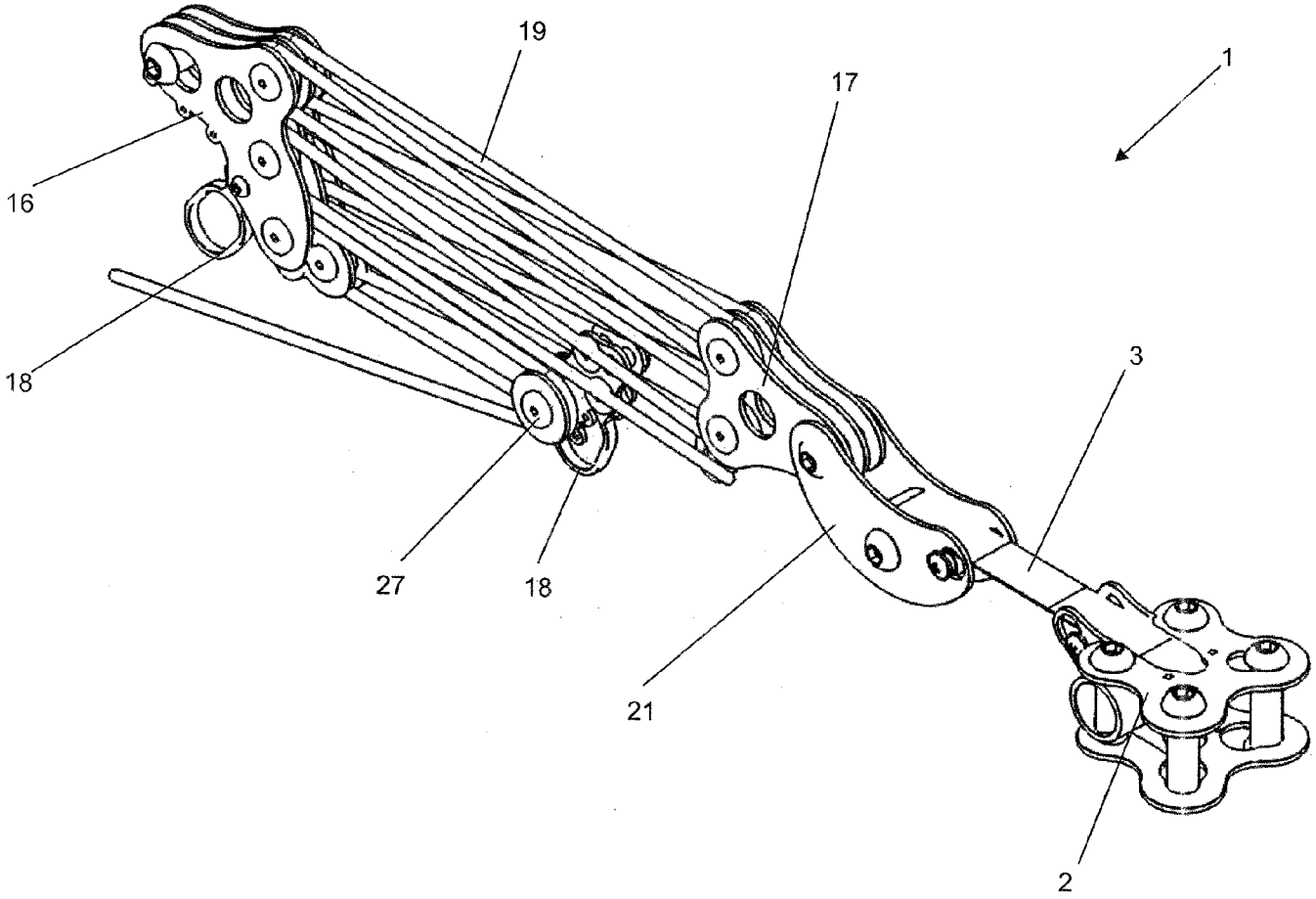
FIG. 2: shows an oblique view of the fastening system according to the invention.

FIG. 2 shows an oblique view of the fastening system 1 according to the invention. The slackline 3 is inserted between the band clamps 2 and 21. The second band clamp 21 is connected to a block and tackle comprising the first block and tackle element 16, the second block and tackle element 17, and a block and tackle rope 19. The first band clamp 2 and the first block and tackle element 16 are fastened to fixing points by means of round slings. In this case as well, a multiplier 27 having a further brake 18 has been engaged on the block and tackle rope 19.

Figure 3:
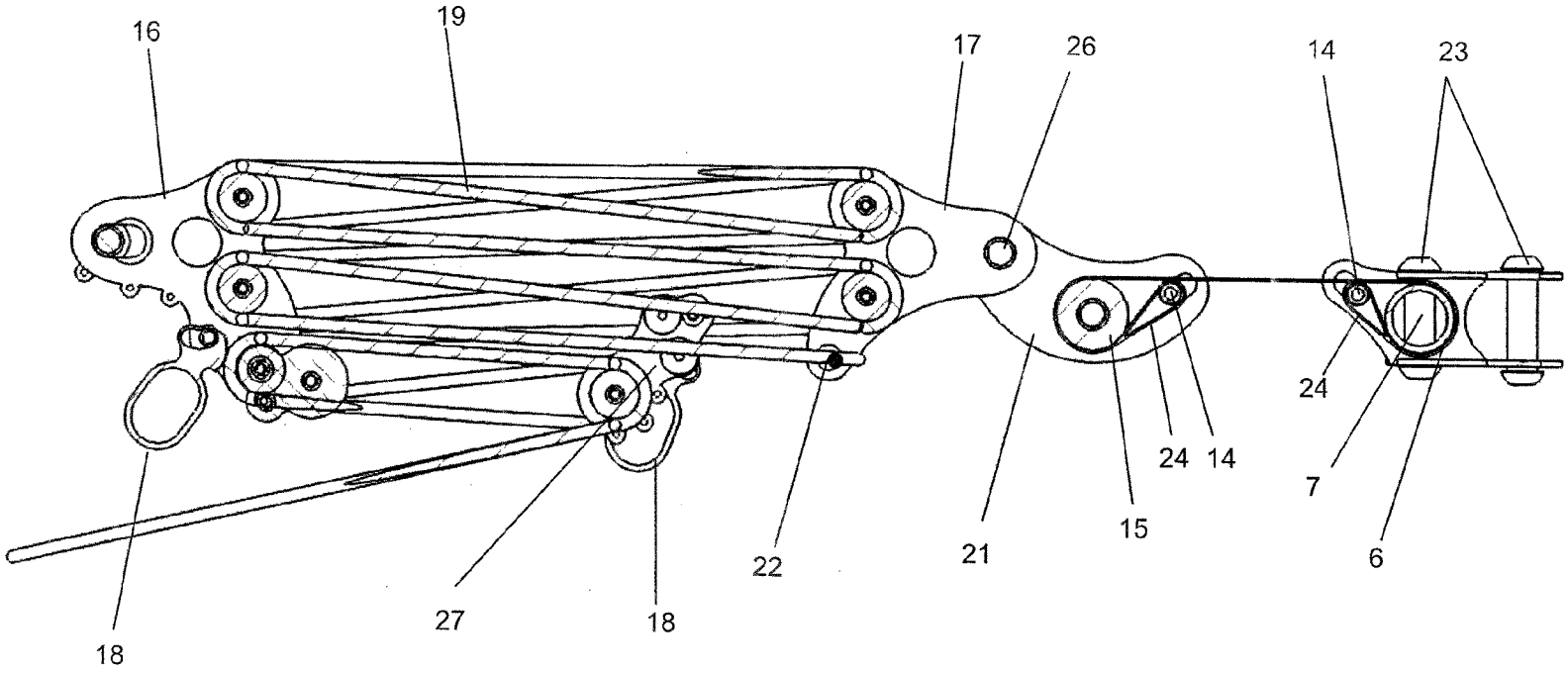
FIG. 3: shows a sectional view of the fastening system according to the invention.

The section through the fastening system 1 according to the invention depicted in FIG. 3 shows particularly dearly how the band clamps 2 and 21 are connected to the slackline 3. The ends of the slackline 3 are guided around deflecting rollers 15 and are anchored in the band clamps 2 and 21 by means of slackline bolts 14. The slackline 3, which has been placed around the deflecting roller 15 and is provided with a loop-shaped end through which the slackline bolt 14 has been passed, is located in the region of the slackline bolt over the loop-shaped end when a tensile load is applied. The elements already shown in FIGS. 1 and 2 are shown again. In this case as well, a multiplier 27 having a further brake 18 is engaged on the block and tackle rope 19.

Figure 4:
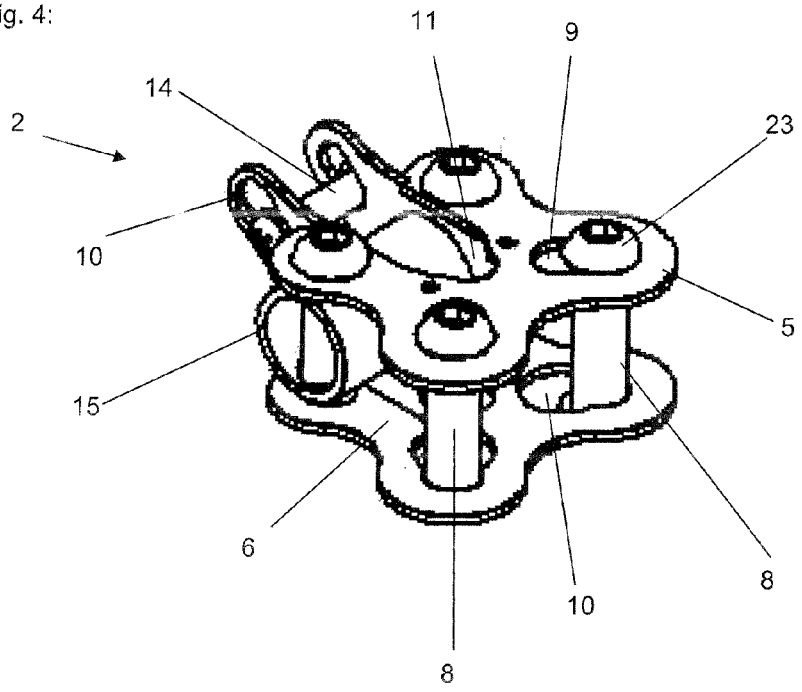
FIG. 4: shows an oblique view of a first band clamp according to the invention.
Figure 12:
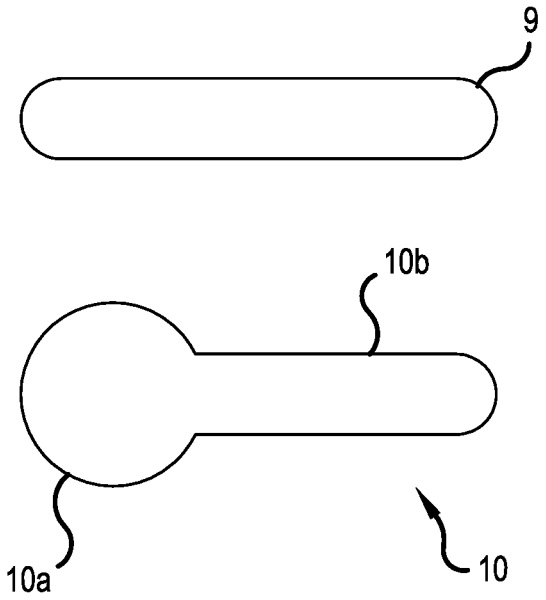
FIG. 12: shows a top view of an elongated hole and a functional hole

FIG. 4 shows a first band clamp 2. The first band clamp 2 comprises an upper base plate 5 and a lower base plate 6. The base plates 5 and 6 are fixedly connected to one another by means of fixing bolts 7. A right guide plate 12 and a left guide plate 13 are disposed between the base plates 5 and 6, at a right angle to base plates 5 and 6. These guide plates 12 and 13 are disposed spaced apart so that a slackline 3 can be inserted between the guide plates 12 and 13. The base plates 5 and 6 have openings 11 for facilitating the insertion. Round-sling bolts 8 are disposed at the ends of the base plates 5 and 6 facing away from the openings 11. The upper base plate 5 has elongated holes 9, in which the round-sling bolts are movably supported. The lower base plate 6, however, has functional holes 10. These functional holes 10 are characterized by a cut-out 10*a* and a recess 10*b* adjoining the cut-out 10*a* (see also FIG. 12). The cut-out 10*a* is dimensioned in such a way that bolt heads 23 of a round-sling bolt 8, which are disposed at both ends of the round-sling bolt 8, fit through the cut-out 10*a*. This does not apply for the adjoining recess 10*b*. When a tensile load is applied to the round sling 4 fastened to the first band clamp 2 via the round-sling bolt 8, the round-sling bolt 8 is pulled into the recess 10*b* and cannot slide in the axial direction. If the tension acting on the first band clamp 2 and the round sling 4 is released, the round-sling bolt 8 becomes moveable in such a way that it enters the region of the cut-out 10*a*. In this position, the bolt can be moved through the lower base plate 6 in the direction of the upper base plate 5. Since the elongated hole 9 does not permit the bolt to be pushed all the way through, this small part cannot get lost. It is also clearly evident that the axes of the round-sling bolts 8 and of the slackline bolt 14 are positioned at a right angle with respect to one another. As a result of this arrangement, it is ensured that tensile forces of the round sling 4 acting on the round-sling bolts 8 are reliably absorbed by the band clamp 2.

Figure 5:
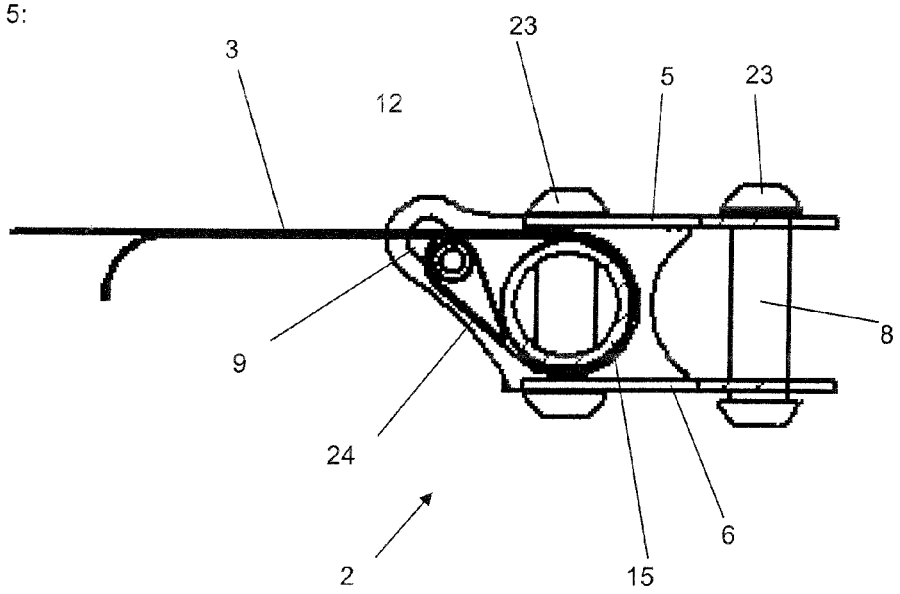
FIG. 5: shows a sectional view of a first band clamp according to the invention.

FIG. 5 shows a section through the first band clamp 2. The slackline 3 has been placed around a deflecting roller 15 and is fastened, by means of a loop 24, to a slackline bolt 14. As described with reference to the round-sling bolts 8 in FIG. 4, this slackline bolt is supported in the guide plates 12 and 13, wherein the right guide plate 12 in the exemplary embodiment has the elongated hole 9, while the non-illustrated left guide plate 13 has the functional hole. The base plates 5 and 6 are connected to one another by fixing bolts 7, on which the deflecting roller 15 is also disposed.

Figure 6:
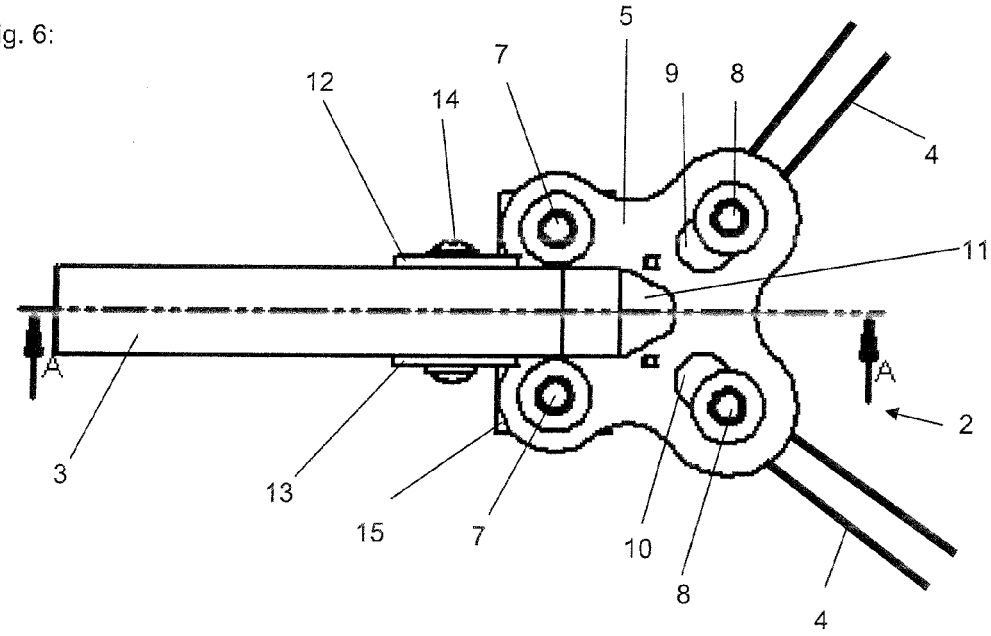
FIG. 6: shows a top view onto a first band clamp according to the invention.

FIG. 6 shows a top view onto the first band clamp 2 according to the invention. Here, the section described in FIG. 5 is indicated by AA. The first band clamp 2 is connected to a non-illustrated fixing point via a round sling 4. Since tension is applied to the round sling 4, the round-sling bolts 8 are displaced in the elongated holes 9 in such a way that the bolts cannot be moved in the direction of their axes. The upper base plate 5 is connected to the right guide plate 12, which is disposed perpendicular to the top base plate 5, and to the left guide plate 13, which is disposed parallel to the right guide plate. The two guide plates 12 and 13 are spaced apart in such a way that a slackline 3 can be inserted between them. The deflecting roller 15 is also connected to the upper base plate via the fixing bolts 7. The slackline 3 is placed around this deflecting roller 15 and is secured by means of a slackline bolt 14. An opening 11 is provided in the upper base plate 5 for simplifying the insertion of the slackline 3 into the first band clamp 2.

Figure 7:
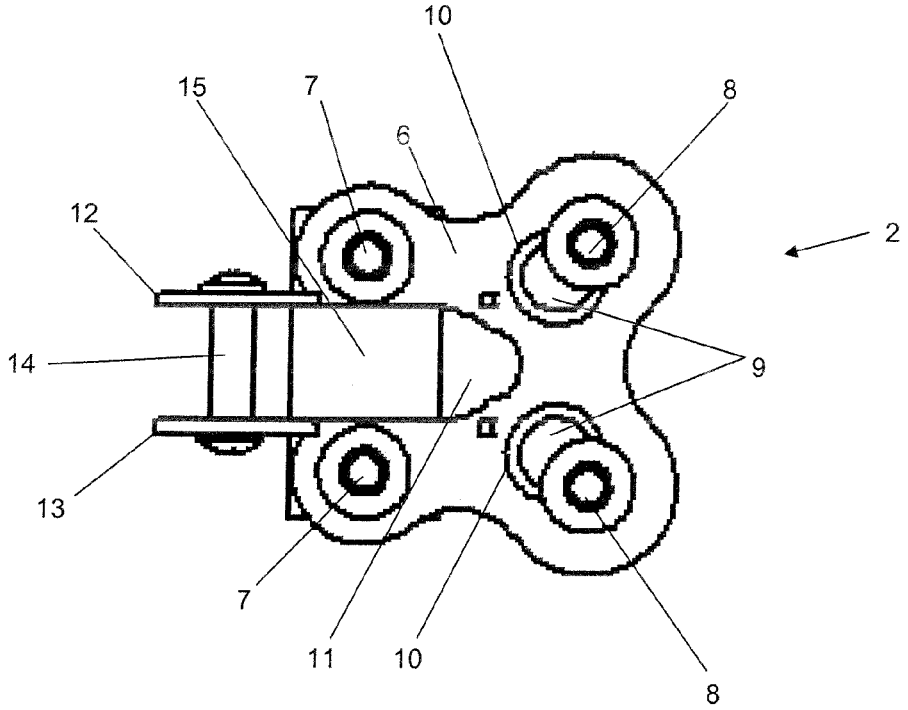
FIG. 7: shows a rear view of a first band clamp according to the invention.

Corresponding to FIG. 6, the underside view of the first band clamp 2 according to the invention is shown in FIG. 7. The lower base plate 6 comprises two functional holes 10, through which the elongated holes 9 in the upper base plate 5 can be viewed. In the example, the round-sling bolts 8 have been slid into the recesses of the functional holes 10, and therefore the bolts cannot be moved vertically. It is evident, however, that the bolt head 23 fits through the cut-out of the functional hole 10. A slackline can be inserted between the guide plates 12 and 13. This slackline, after having been placed around a deflecting roller 15, can be connected to the first band clamp 2 by means of the slackline bolt 14. This deflecting roller 15 is connected to the lower base plate 6 by means of fixing bolts 7.

Figure 8:
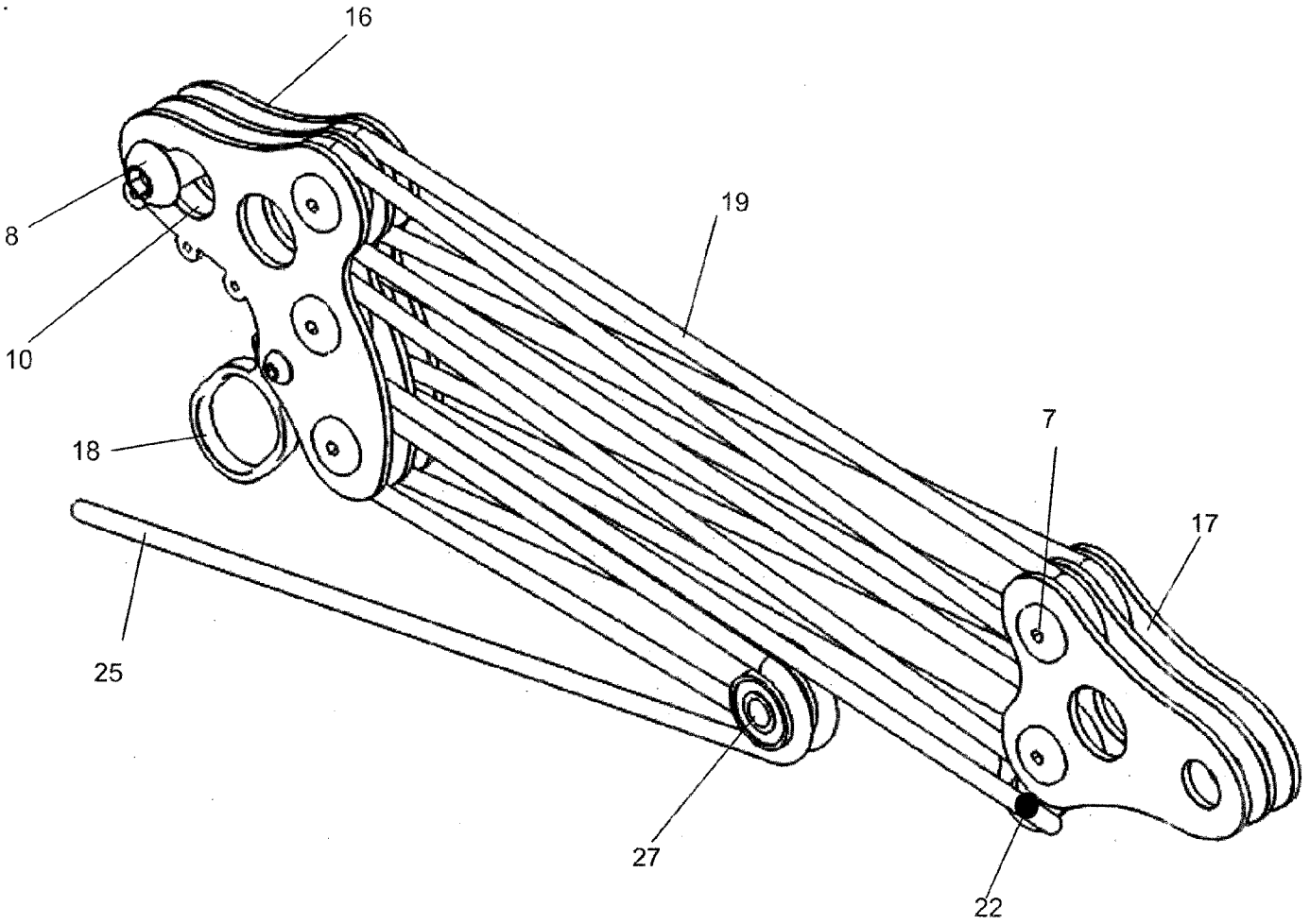
FIG. 8: shows an oblique view of a block and tackle according to the invention.

FIG. 8 shows the block and tackle in greater detail. A block and tackle rope 19 is provided between a first block and tackle element 16 and a second block and tackle element 17. The block and tackle rope 19 is fastened, by means of a knot 22, to the second block and tackle element 17 and is then extended between the block and tackle elements 16 and 17 by way of a plurality of rollers 20 before it passes along a brake 18 according to the invention and terminates as a loose end 25. The block and tackle is actuated by pulling on the loose end 25. The brake 18 prevents the block and tackle rope 19 from coming loose during the use of the fastening system 1 according to the invention and thereby endangering the user. Releasing the brake 18, however, makes it possible to take down the fastening system 1. An elongated hole 9 and functional holes 10 are also provided in the first block and tackle element 16. In the example, the first block and tackle element consists of three planar elements disposed parallel to one another. Two planar elements lying next to one another have functional holes 10 and the third planar element has an elongated hole 9. The round-sling bolt 8 can also be pushed through the functional holes 10 in this case. After the round sling 4 is inserted, wherein each end is inserted between two of the planar elements, the round-sling bolt 8 can be pushed back into its original position. When a tensile load is applied to the block and tackle, the round-sling bolt 8 moves back in the direction of the elongated holes or into the recesses of the functional holes and thereby prevents the round sling from inadvertently coming loose from the block and tackle. A multiplier 27 is also shown.

Figure 9:
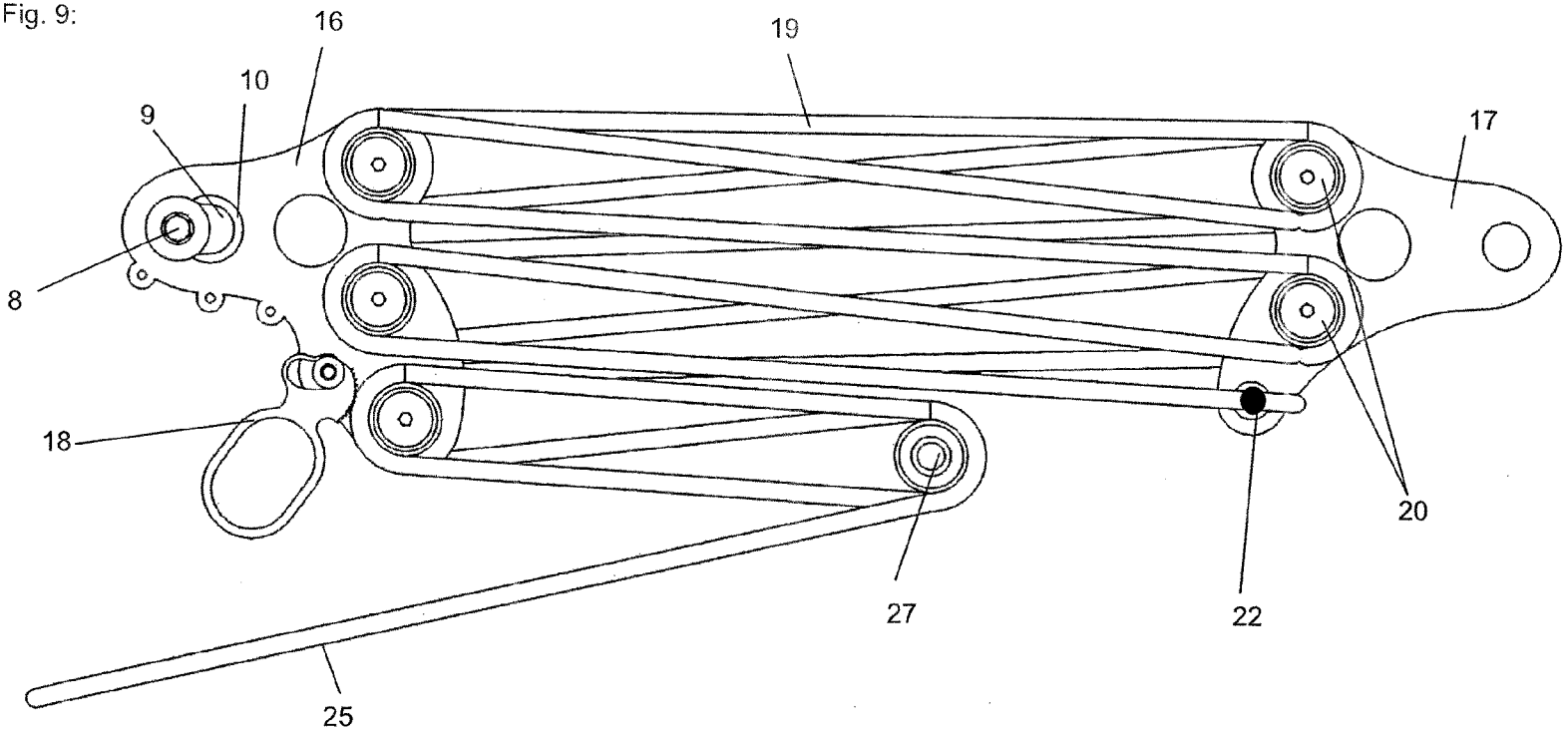
FIG. 9: shows a sectional view of a block and tackle according to the invention.

The sectional view in FIG. 9 clearly shows how the rollers 20 are disposed in the block and tackle elements 16 and 17. In addition, the system comprising the elongated hole 9 and the functional hole 10 on the first block and tackle element 16 is also clearly evident. A roller in the multiplier 27 is also apparent here.

Figure 10:
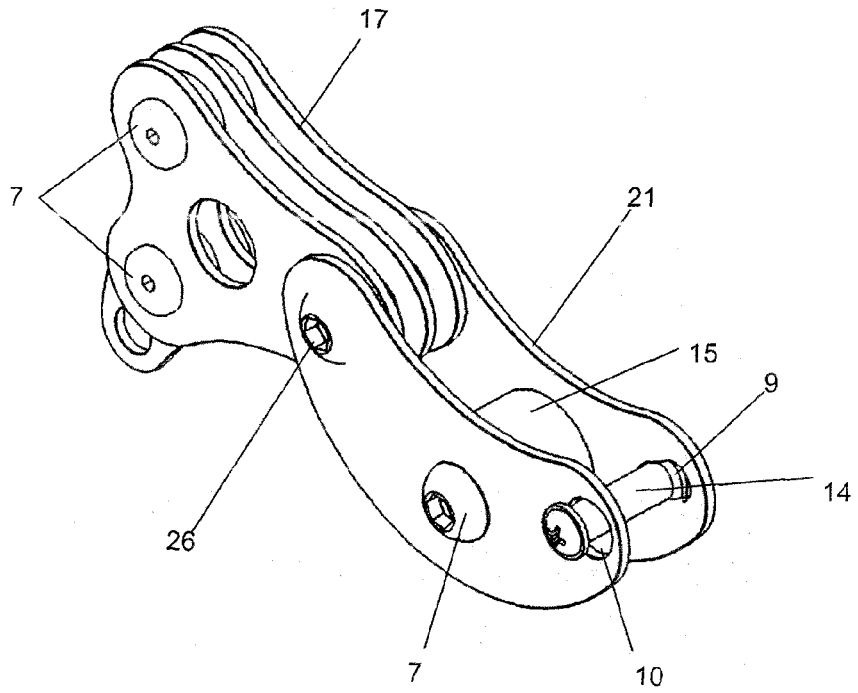
FIG. 10: shows an oblique view of a second band clamp.
Figure 11:
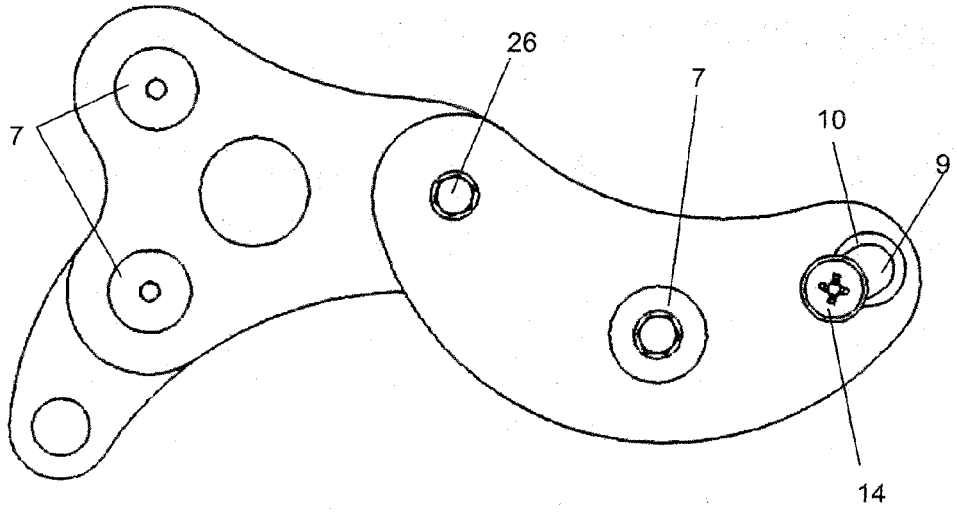
FIG. 11: shows a side view of a second band clamp.

FIG. 10 shows an oblique view of the second block and tackle element in interplay with the second band clamp 21. As is the case with the first band clamp 2, the second band clamp 21 also comprises a deflecting roller 15 and a slackline bolt 14. In this case as well, the slackline bolt 14 is guided in an elongated hole 9 and can be moved side-to-side in the direction of its axis through a functional hole 10. The deflecting roller 15 and side parts of the second band clamp are connected to one another by means of a fixing bolt 7. The second band clamp 21 is rotatably coupled to the second block and tackle element 17 by a pivot pin 26, which acts as a fixing bolt 7, but allows the fixed parts to rotate relative to one another. Finally, the content of FIG. 10 is shown once more, in a side view, in FIG. 11.

Since the aforementioned band clamps and block and tackle elements described in detail are exemplary embodiments, they can be modified by a person skilled in the art in the usual manner within a broad scope without departing from the scope of the invention. In particular, the specific embodiments of the band clamps can also have a form other than that described here. The block and tackle can also be designed in another form, if this is necessary in order to reduce the amount of force required or for design-related reasons. In addition, the use of the indefinite article "a" does not exclude the possibility of more than one of the relevant features being present.

The invention claimed is:

1. A sports and recreation device, comprising a slackline, first and second band clamps, a block and tackle, a brake, and two loop-shaped slings, wherein the first band clamp has two sling bolts and one slackline bolt, the second band clamp has one slackline bolt and the block and tackle has one sling bolt, wherein the sling bolts and the slackline bolts are guided in elongated holes and functional holes of the first band clamp, the second band clamp and the block and tackle and are configured to be removable through cut-outs of the functional holes in the direction of their axis, all the elongated holes and the functional holes being in a plane perpendicular to an axis of the sling bolts and the slackline bolts, each of the sling bolts and the slackline bolts comprising bolt heads at each end, the bolt heads having a diameter that is smaller than the cut-outs of the functional holes but is larger than a width of the elongated holes.

2. The sports and recreation device according to claim 1, wherein the block and tackle comprises a first block and tackle element, a second block and tackle element and a block and tackle rope; and the brake is fixedly connected to the first block and tackle element or the block and tackle rope.

3. The sports and recreation device according to claim 2, wherein the block and tackle elements and band clamps are made from a light metal.

4. The sports and recreation device according to claim 1, wherein the slackline bolt of the first band clamp is disposed at a substantially right angle to the two sling bolts of the first band clamp.

5. The sports and recreation device according to claim 1, wherein a multiplier is provided on the block and tackle.

6. A sports and recreation device, comprising:

a slack line in the form of a band, first and second band clamps engaging the slack line for clamping the slack line at respective locations spaced from each other along a length of the slack line, a block and tackle provided with a brake for selectively fixing a distance between extremities of the block and tackle, first and second block and tackle elements defining extremities of the block and tackle, a first sling connected to the first block and tackle element, the second band clamp, at a first end portion thereof, being connected to the second block and tackle element, and, at a second end portion thereof, opposite the first end portion, being configured to receive a portion of the slack line, the first band clamp, at one end portion thereof, being configured to receive another portion of the slack line, a second sling connected to another, opposite end portion of the first band clamp, and wherein:

the first and second block and tackle elements each have three plates spaced from each other and the second band clamp has a pair of opposed plates spaced from each other, the first block and tackle element having one bolt and the second band clamp having one bolt, each of the bolts being of round cross-section and having, at each end thereof, a bolt head of a greater diameter than a diameter of the bolts, a first two of the plates of the first block and tackle element and one of the plates of the second band clamp having a functional hole for receiving the respective bolts, each of the functional holes having a portion of lesser width and, contiguous therewith, a portion of greater width, the portion of lesser width being of a width greater than the diameter of the bolt and less than a diameter of the bolt heads, the portion of greater width being of a width greater than the diameter of the bolt heads, a third one of the plates of the first block and tackle element and the other of the plates of the second band clamp having an elongated hole having a diameter less than the diameter of the bolt heads, each of the elongated holes receiving a respective bolt which is also received in the functional holes, the first band clamp having a bolt that engages a respective loop-shaped sling, and the bolt of the second band clamp engaging the slack line.

* * * * *